US005331738A

United States Patent [19]

Lingemann

[11] Patent Number: 5,331,738

[45] Date of Patent: Jul. 26, 1994

[54] COLOR-COATED SPACER TUBE FOR INSULATING GLAZINGS, AND METHOD AND APPARATUS FOR ITS PRODUCTION

[75] Inventor: Horst Lingemann, Wuppertal, Fed. Rep. of Germany

[73] Assignee: Helmut Lingemann GmbH & Co., Wuppertal, Fed. Rep. of Germany

[21] Appl. No.: 527,490

[22] Filed: May 23, 1990

[30] Foreign Application Priority Data

May 4, 1990 [DE] Fed. Rep. of Germany ..... 4014376

[51] Int. Cl.[5] ..... B21B 5/00

[52] U.S. Cl. ..... 29/897.312; 428/35.8; 29/527.2; 52/788; 52/790; 52/479; 427/178; 118/100; 118/110; 118/DIG 11; 118/118

[58] Field of Search ..... 29/527.2, 897.312; 428/35.8; 52/790, 788, 479, 481; 427/178; 118/100, 110, DIG. 11, 118

[56] References Cited

U.S. PATENT DOCUMENTS 3,579,772 5/1971 Coad ..... 29/33

*Primary Examiner*—George F. Lesmes
*Assistant Examiner*—Charles R. Nold
*Attorney, Agent, or Firm*—Amster, Rothstein & Ebenstein

[57] ABSTRACT

The invention relates to a spacer tube of metal, in particular of aluminum, for frame or strut bars of an insulating glazing as spacer or respectively drying agent container between two continuous glass panes, a color stripe being imprinted on the inner wall of the spacer tube visible in the insulating glazing and preferably subsequently gas exchange openings are provided in the inner wall. Further the invention relates to a method for the production of a spacer tube, several color strips being imprinted in side-by-side arrangement on the surface of a metal strip, preferably simultaneously, using a rotary printing mechanism, the paint is dried, and the metal strip is divided longitudinally between the color stripes, and the resulting metal slats are shaped to form spacer tubes and are cut to length.

6 Claims, 2 Drawing Sheets

COLOR-COATED SPACER TUBE FOR INSULATING GLAZINGS, AND METHOD AND APPARATUS FOR ITS PRODUCTION

The invention relates to a color-coated spacer tube for insulating glazings as well as to a method and an apparatus for the production of such spacer tubes.

Spacer tubes of metal, e.g. aluminum, are bent to form a spacer frame or assembled with corner connectors and are arranged in an insulating glazing between two glass panes, keeping a distance. The tubes are filled with drying agent, the wall toward the interior of the insulating glazing being punched or perforated or the like for gas permeability, the drying agent being unable to issue from the tubes yet effectively communicating with the interior atmosphere of the insulating glazing. Also there may be formed from spacer tubes interior struts e.g. for coffered windows with insulating glazing with continuous glass panes. The struts are, as a rule, not filled with drying agent, but show, for aesthetic reasons, the same holes or perforations or the same openings as the spacer frame bars in the region of the window frames.

Window frames, in particular of metal, are often made in color. An optically disturbing factor here is in insulating glazings the glossy or semi-gloss appearance of the spacer frame bars or struts. For this reason, spacer tubes and struts have been provided which are coated with color [ink/paint] on the inner walls presenting the gas apertures or openings. Applying the color is done by hand with a spray gun onto the fully manufactured tubes, which for this purpose are assembled as a packet so that a large-area surface is available. During spraying, paint penetrates into the gas apertures and clogs them, so that the gas exchange between the drying agent and the interior atmosphere may be impaired. The spraying usually results in an uneven, relatively thick coat of paint, so that the color application may look unattractive. The process of color application is very time-consuming and the consumption of paint is rather high, so that the colored products are relatively expensive.

It is the object of the invention to provide in an inexpensive and quick manner spacer tubes and struts with a homogeneous and thinly coated colored surface, the gas apertures of which are not clogged with paint.

In the following, the invention will be explained more specifically by way of example with reference to the drawing, in which:

Figure 1:
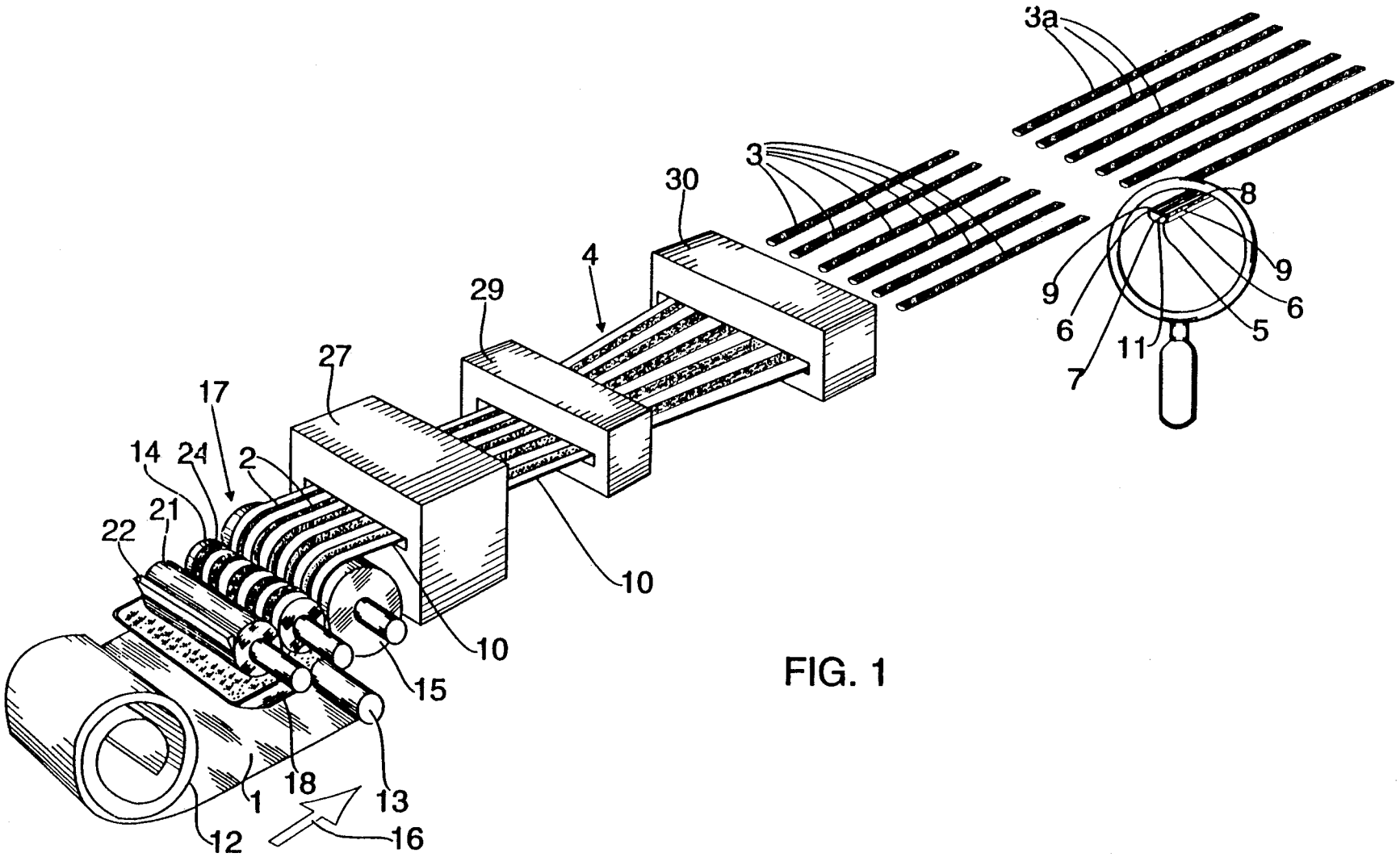
FIG. 1 shows schematically and in perspective an apparatus for the production of color-coated spacer tubes.

In the folowing there will be mention of spacer tubes exclusively. The term, however, includes also tubular struts which too are disposed in the interior of an insulating glazing, keeping a distance if desired.

According to the invention, a metal strip 1, e.g. of a thickness between 0.5 and 2 mm, e.g. an aluminum strip, as intermediate product, is coated in longitudinal direction in stripes, several parallel color stripes 2 being applied. The width of the metal strip 1 is a multiple of the width required for the production of a single spacer tube 3. As a minimum the width of the color stripe 2 corresponds appropriately to the width of the inner wall 5 of a spacer tube 3, which has in addition the sidewalls 6 and outer wall 7. The inner wall 5 has in longitudinal direction gas exchange apertures 8, e.g. in rows.

Preferably the width of the color stripe 2 is somewhat greater, e.g. 1 to 2 mm greater, than the width of the inner wall 5, so that in the finished spacer tube 3 the color stripe 2 overlaps the lateral edges 9 between inner wall 5 and side, rails 6. In the insulating glazing the lateral edges 9 are usually still visible and, unless they are coated, show a glossy, optically disturbing line. Due to the lateral edges 9 being overlapped by color stripes 2, the lateral edges are covered up and create the impression that the spacer tube as a whole is color-coated on the surface.

If several spacer tubes 3 of equal dimensions and width are to be produced from the metal strip 1, the width of application of the color stripes may be the same. According to the example shown in FIG. 1, spacer tubes 3 of different width and height are produced from the metal strip 1. Accordingly, the first intermediate product, the metal strip 10 imprinted with color stripes 2, has color stripes 2 of different width. The thickness of the paint in the color stripes 2 is preferably as little as 10 to 20 /μm.

The first intermediate product, the metal strip 10, can be reeled and made available as such for further processing. Or it may be cut lengthwise according to the strip width needed for the production of the spacer tubes 3, so that there result the metal slats 4, coated with a color stripe 2, as a further intermediate product, from which the spacer tubes 3 can be shaped in a manner known in itself, e.g. by rolling. The metal slats 4 can be reeled as intermediate products and made available for tube production. According to the invention, the punching of the gas exchange apertures 8 is done after the aplication of paint, namely either in the metal strip 10 or in the metal slat 4 or—as usual—during or just before shaping. In either case it is provided that the application of paint will not clog the gas exchange apertures. The subsequent formation of the gas exchange apertures is readily visible on the finished spacer tube 3.

If spacer tubes 3 welded by a longitudinal weld seam 11 are to be produced from the metal slat 4, the weld seam 11 is disposed outside the color stripe 2, appropriately in the outer wall 7.

From the apparatus according to the invention, illustrated in FIG. 1, the new method for the production of color-coated spacer tubes 3 or respectively of the intermediate products 10 and 4 can be seen.

The rolled-up aluminum strip 1 is drawn off a reel 12 and guided over a guide roller 13 between the impression cylinder 14 and counter impression roll 15 of a printing mechanism 17 in the direction of arrow 16. The printing mechanism 17, shown in greater detail in FIGS. 2 and 3, includes, as usual, a paint vat 18, a paint take-up roll 19, the impression roll 14, a paint distributing roll 20, a wiper roll 21 with wiper 22, as well as the counter impression roll 15 and a motor drive 23 for the rolls. The arrangement of the rolls is similar to the usual construction of a printing mechanism. The paint take-up roll 19 can dip into the vat 18, contacts the impression roll 14, and transfers paint to it. The paint distributing roll 20 distributes the paint on the impression roll 14 made of metal, e.g. steel, on the surface and homogeneously, before the paint is transferred to the metal strip 1. With the wiper 22 the wiper roll 21 scrapes off the paint received from the paint distributing roll 20, which paint can flow back into the vat 18. The impression roll 14 transfers the paint that has remained on it to the aluminum strip 1.

According to the invention, in particular the impression roll 14 is of disk type design and presents the printing disks 24 of metal, e.g. steel, arranged side by side. The width of the impression disks 24 corresponds to the width of the color stripes 2 to be printed, and their spacing corresponds to the desired mutual spacing of the color stripes 2. According to the invention, there is used an impression roll 14 with a hollow hydraulic mandrel filled with hydraulic fluid under a predetermined pressure, so that the surface of the impression roll or respectively of the impression disks 24 has a predetermined exact distance from the roll axis. In this manner a very exact concentricity of the impression roll can be ensured and in addition it can be ensured that a certain, relatively thin layer of paint of about 10 to 20/μm is transferred to the aluminum strip 1, and thus the distance between the impression surfaces of the impression roll 14 and of the abutment surface, also consisting of metal, e.g. steel, of the counter impression roll 15 always corresponds, in the nip 25, to the thickness of the aluminum strip 1 to be imprinted, so that the thin layer of paint is transferred with the required force.

Figure 2:
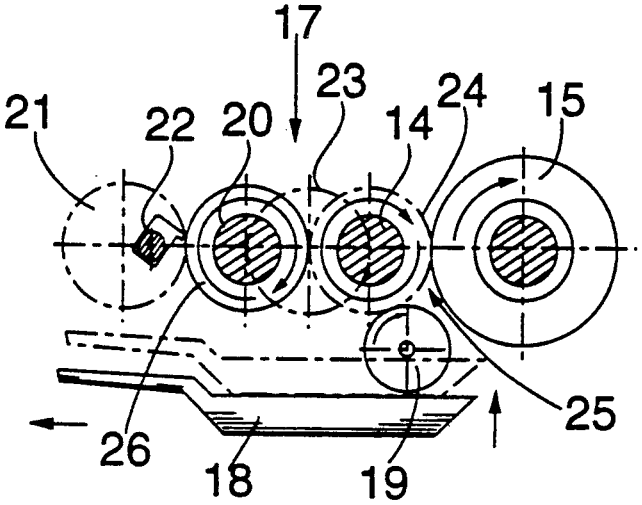
FIG. 2 a side view of the printing mechanism for color application.
Figure 3:
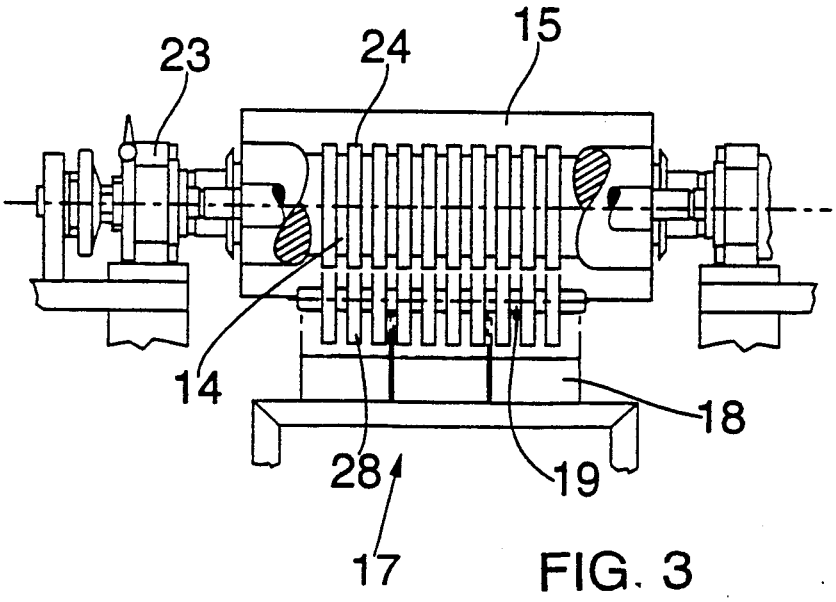
FIG. 3 a front view of the printing mechanism without color distributing and wiper rollers.

Like the impression roll 14, also the paint distributing roll 20 may—as illustrated in FIGS. 2 and 3—be equipped with disks 26, which correspond to the disks 24 and contact them.

According to a special form of realization of the invention, also the paint take-up roll 19 is equipped with disks 28 corresponding to the disks 24, and the vat 18 is compartmentalized (not shown) by longitudinal walls in transport direction of the strip 1, so that the vat compartments can contain different paints. With such a printing mechanism different colors can be printed on simultaneously.

FIGS. 2 and 3 show disks 24 of equal width. The example of a printing mechanism 17 illustrated in FIG. 1 has no paint distributing roll and no paint take-up roll. The printing disks 24 have different width and hence print color stripes 2 of different width. Naturally, the printing disks 24 of different width my be provided also in the printing mechanism according to FIG. 2 and 3.

An apparatus according to the invention for the production of color-coated spacer tubes has a dryer 27 arranged after the printing mechanism 17 and followed by a splitting unit 29, e.g. a longitudinally cutting shear which cuts the strip 1 lengthwise and divides it into metal slats 4. The metal slats 4 enter a shaping or rolling device which follows the splitting unit 29 and possibly has a welding equipment 30, in which the spacer tubes 3 are shaped and which they leave as continuous tubing, whereupon they are merely cut to a predetermined length as pieces 3*a*.

It is within the scope of the invention to reel the imprinted strip 10 and to treat it as an intermediate product. Likewise it is within the scope of the invention to reel the longitudinally divided metal slats 4 and to treat them as intermediate products.

Appropriately, the surface of the metal strip i is treated, before being imprinted, to improve the paint absorption or paint adhesion, e.g. degreased.

The overlap of the color stripes 2 may, according to the invention, be provided on one or both sides, and in the latter case the overlap may be the same or different. The latter occurs e.g. for glazings with different rabbets.

With the invention it is possible to considerably simplify the application of paint on spacer tubes and to provide a colored surface which gives a homogeneous optical impression and for the production of which relatively little paint is used up.

I claim:

1. Method for the production of a spacer tube of metal for frame or strut bars of an insulating glazing as spacers or drying agent containers between two continuous glass panes, characterized by the steps in chronological order of:

(A) printing on the surface of a metal strip several color stripes in juxtaposed arrangement by a rotary printing mechanism;

(B) drying the colored stripes;

(C) cutting the metal strip longitudinally between the color stripes; and (D) shaping the resulting metal slats to form spacer tubes and cutting them to length, the color strips being disposed on an outer surface of the spacer tube facing the interspace between the glass panes and visible in the insulating glazing.

2. Method according to claim 1, characterized by the step of welding longitudinally the shaped spacer tubes.

3. Method according to claim 1, including the step of pretreating the surface of the metal strip (1) to be imprinted to improve the paint absorption or paint adhesion.

4. Method according to claim 3, including the step of degreasing the surface to be imprinted.

5. Method according to claim 1, characterized in that color stripes of different width are imprinted.

6. Method according to claim 1, characterized in that color stripes of different color are imprinted.

* * * * *